US012435603B2

(12) United States Patent
Newton

(10) Patent No.: US 12,435,603 B2
(45) Date of Patent: Oct. 7, 2025

(54) ENHANCED EXPANDABLE LINER HANGER RIB ENGAGEMENT MECHANISM

(71) Applicant: Halliburton Energy Services, Inc., Houston, TX (US)

(72) Inventor: Daniel Newton, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 121 days.

(21) Appl. No.: 17/969,306

(22) Filed: Oct. 19, 2022

(65) Prior Publication Data

US 2024/0133273 A1 Apr. 25, 2024
US 2024/0229615 A9 Jul. 11, 2024

(51) Int. Cl.
*E21B 43/10* (2006.01)

(52) U.S. Cl.
CPC ..... *E21B 43/105* (2013.01)

(58) Field of Classification Search
CPC ..... E21B 43/105
See application file for complete search history.

(56) References Cited

U.S. PATENT DOCUMENTS 7,178,590 B2 * 2/2007 Vargo, Jr. ..... E21B 33/13 507/140
7,748,468 B2 * 7/2010 Casciaro ..... E21B 33/1208 166/387
8,983,819 B2 * 3/2015 Jiang ..... E21B 21/08 703/10
9,850,737 B2 12/2017 Liu et al.
9,920,585 B2 3/2018 Murphree et al.
11,667,091 B2 * 6/2023 Coppola ..... B29C 33/52 521/54
2006/0236541 A1 10/2006 Prucher
2006/0243456 A1 * 11/2006 Faul ..... E21B 17/1078 166/373
2019/0063191 A1 * 2/2019 Roussie ..... E21B 34/06
2021/0189842 A1 * 6/2021 Greci ..... E21B 33/13
2021/0404298 A1 12/2021 Newton et al.

OTHER PUBLICATIONS

Crushable Foam—2021, AFGlobal, availabe at https://afgholdings.com/afglobal/subsea/crushable-foam/.
Surety, Casing Guard annular pressure build-up (APB) mitigation, 1980.

(Continued)

*Primary Examiner* — Nicole Coy
*Assistant Examiner* — Nicholas D Wlodarski
(74) *Attorney, Agent, or Firm* — Scott Richardson; C. Tumey Law Group PLLC

(57) ABSTRACT

Systems and methods of the present disclosure relate to downhole tools including expandable liner hangers that used a foam member to increase fluid volume in voids defined by the hanger and the casing. A system comprises a downhole tool comprising a tubular body, ribs extending along a circumference of the tubular body, and at least one foam member disposed on the tubular body and between the ribs. The system also includes a conduit. The downhole tool is disposed in the conduit. A void is defined by the tubular body, the ribs, and the conduit, and the foam member is disposed in the void.

18 Claims, 7 Drawing Sheets

(56) References Cited

OTHER PUBLICATIONS

CRP-Subsea-Crushable-Foam-Wrap, Preventing excessive pressure, available at https://www.crpsubsea.com/products/product-families/downhole-protection/crushable-foam-wrap/.
Matrix, syntactic-foam-brochure, Jul. 10, 2020.
Engineering360, Trelleborg Offshore Foams and Foam Materials Data Sheets, available at https://datasheets.globalspec.com/ds/4244/TrelleborgOffshore.

* cited by examiner

ENHANCED EXPANDABLE LINER HANGER RIB ENGAGEMENT MECHANISM

BACKGROUND

Typically, expandable liner hangers (ELH) rely on multiple metal ribs contacting an inner diameter (ID) of casing to set the ELH. This creates a void between the ELH body, the adjacent ELH ribs, and the casing ID that the ribs have contacted upon expansion. This void may be filled with non-compressible fluid which limits the engagement of the ribs to the casing ID during the expansion process.

Alternatively, the void may be filled with a compressible fluid which allows unrestrained engagement of the ribs with the casing ID, but during subsequent thermal cycles, the fluid may expand and reduce rib engagement with the casing ID. One existing design of ELH incorporates an elastomer in the void so that no fluid is trapped, however, the elastomer fills the void which may restrict full engagement of the ribs to the casing ID.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates to an ELH mechanism for increasing the effective volume in the void space once the ribs engage the casing ID allowing for full engagement during expansion, as well as mitigating a reduction of engagement forces for the ribs during thermal cycles (e.g., urges engagement of the ribs against the casing). The void space may be defined by a body of the ELH, the ribs, and the casing ID. The ELH mechanism incorporates a closed cell foam member within the void space between adjacent ribs. The foam has a solid mass (at least partially solid) of known total volume including a percentage (e.g., 5%-80%) for air composition via air pockets that are not connected to the surrounding void. This closed cell structure has porosity but no permeability.

The available fluid volume between the ribs is the rib-to-rib volume less the volume of the closed cell foam member in its run-in-hole (RIH) state. The foam member when exposed to either increased pressure from adjacent fluid or to mechanical load from the expansion process, collapses, and crushes the air pockets thereby reducing the volume of the foam member in addition to connecting some or all of the air pockets to the outside void.

With the reduction of the total volume of the foam and inclusion of some of the foam air pocket volumes to the available fluid volume, the available fluid volume between the ribs increases upon failing of the foam. This increased fluid volume then allows for unrestricted rib expansion with non-compressible fluids or mitigates rib engagement reduction from compressible fluid expansion due to thermal cycles. The mechanism also provides a minimal increase in buoyancy, thereby reducing the effective weight of the hanger which facilitates deployment in extended reach wells. The mechanism also mitigates any pressure increase in the fluid volume through thermal expansion.

The foam member may be manufactured from any number of materials for example, polymers such as polyurethane, elastomers, metals, ceramics, resins, and/or composites. The foam may fill the entire void between the ribs or at least a portion of the void. The foam may be shaped in any geometry within the spacing between the adjacent ribs and may include a single member or multiple members spaced around the body of the hanger. The percentage of air pockets may be modified to engineer the collapse pressure/load to the specific scenario. The air pockets may incorporate or be generated by hollow beads/spheres to further enhance collapse capacity. These spheres can be made from glass, composite, ceramic, polymer, metal and/or other materials. The foam member may be attached to the ELH member in a variety of ways including bonded directly, mechanically connected, a combination of both or other means.

Figure 1:
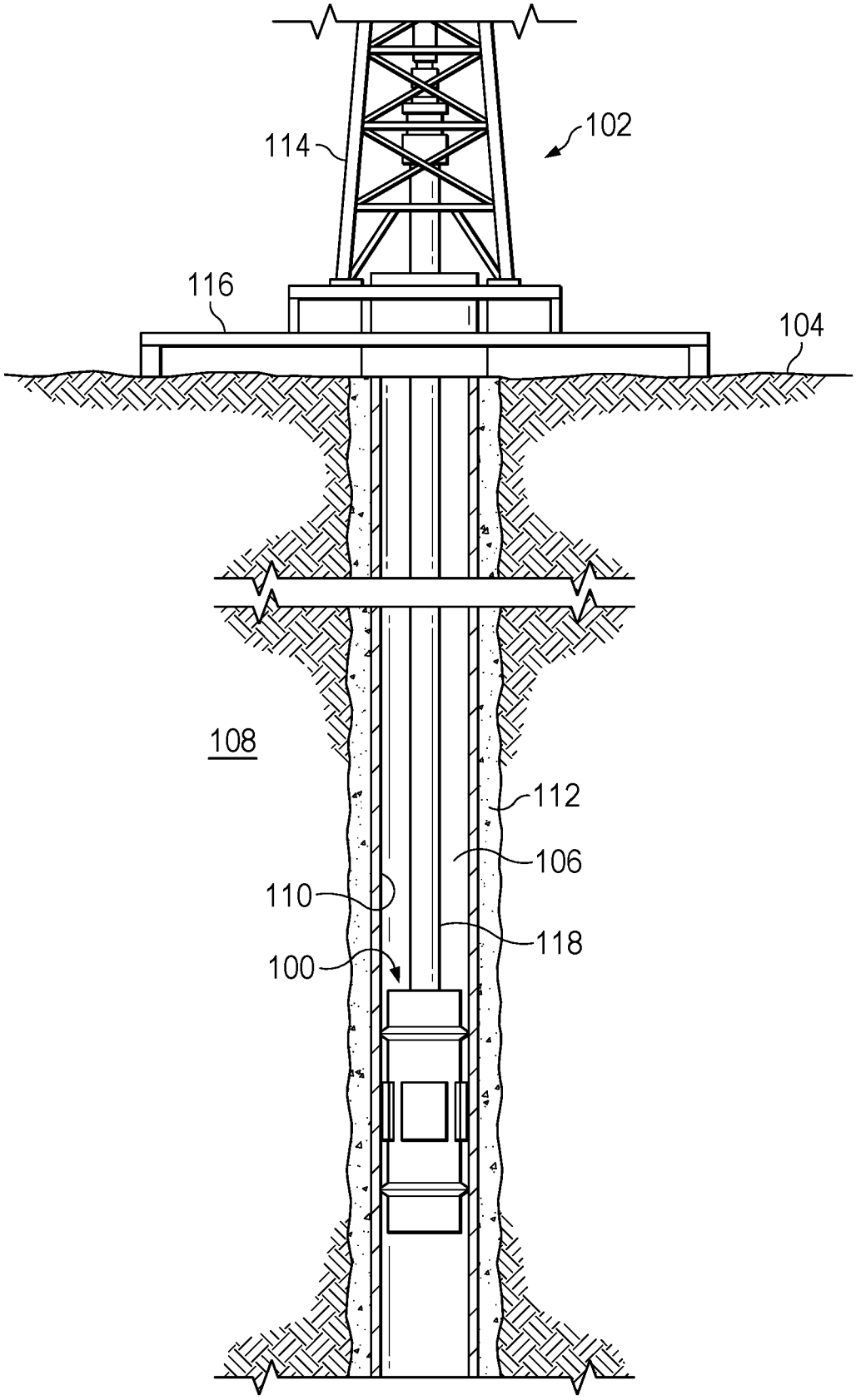
FIG. 1 illustrates an operating environment for a downhole tool including an ELH, in accordance with examples of the present disclosure.

FIG. 1 illustrates an operating environment for a downhole tool 100, in accordance with examples of the present disclosure. A drilling rig 102 is positioned on the earth's surface 104 and extends over and around a wellbore 106 that penetrates a subterranean formation 108 for the purpose of recovering hydrocarbons. At least a portion of the wellbore 106 may be lined with casing 110 that is cemented into position against the formation with cement 112. The drilling rig 102 includes a derrick 114 with a rig floor 116 through which a conveyance such as for example a conduit 118, such as a wireline, jointed pipe, or coiled tubing, for example, extends downwardly from the drilling rig 102 into the wellbore 106. The conduit 118 suspends the downhole tool 100, which may comprise an ELH, for example, as it is being lowered to a predetermined depth within the wellbore 106 to perform a specific operation. The drilling rig 102 includes a motor driven winch and other associated equipment for extending the conveyance 118 into the wellbore 106 to position the downhole tool 100 at the desired depth.

Figure 2:
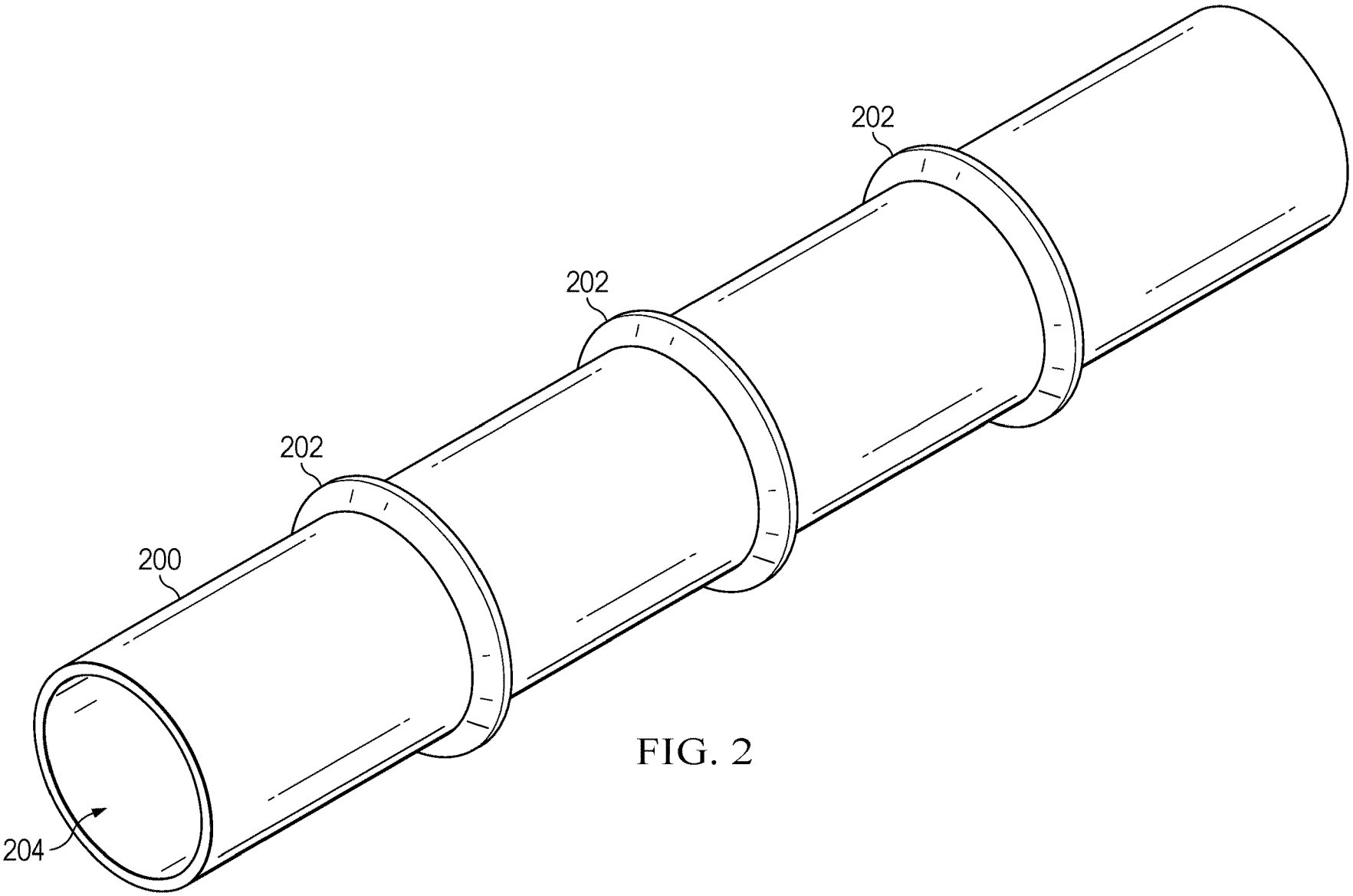
FIG. 2 illustrates a perspective view of the ELH, in accordance with examples of the present disclosure.

FIG. 2 illustrates a close-up view of the tool 100, in accordance with examples of the present disclosure. The tool 100 includes a body 200. As noted above, the tool 100 may include an ELH. The body 200 may be hollow and cylindrical and may be made of metal, such as steel for example. Ribs 202 may be protrusions that are disposed circumferentially around the body 200 and configured to engage the casing ID. Spacing between the protrusions may vary (e.g., 4-24 inches or more). The body 200 and the ribs 202 are configured to expand with a setting tool that may include a cone to expand the tool 100 (e.g., ELH) as it passes through a passage 204 of the tool 100.

Figure 3:
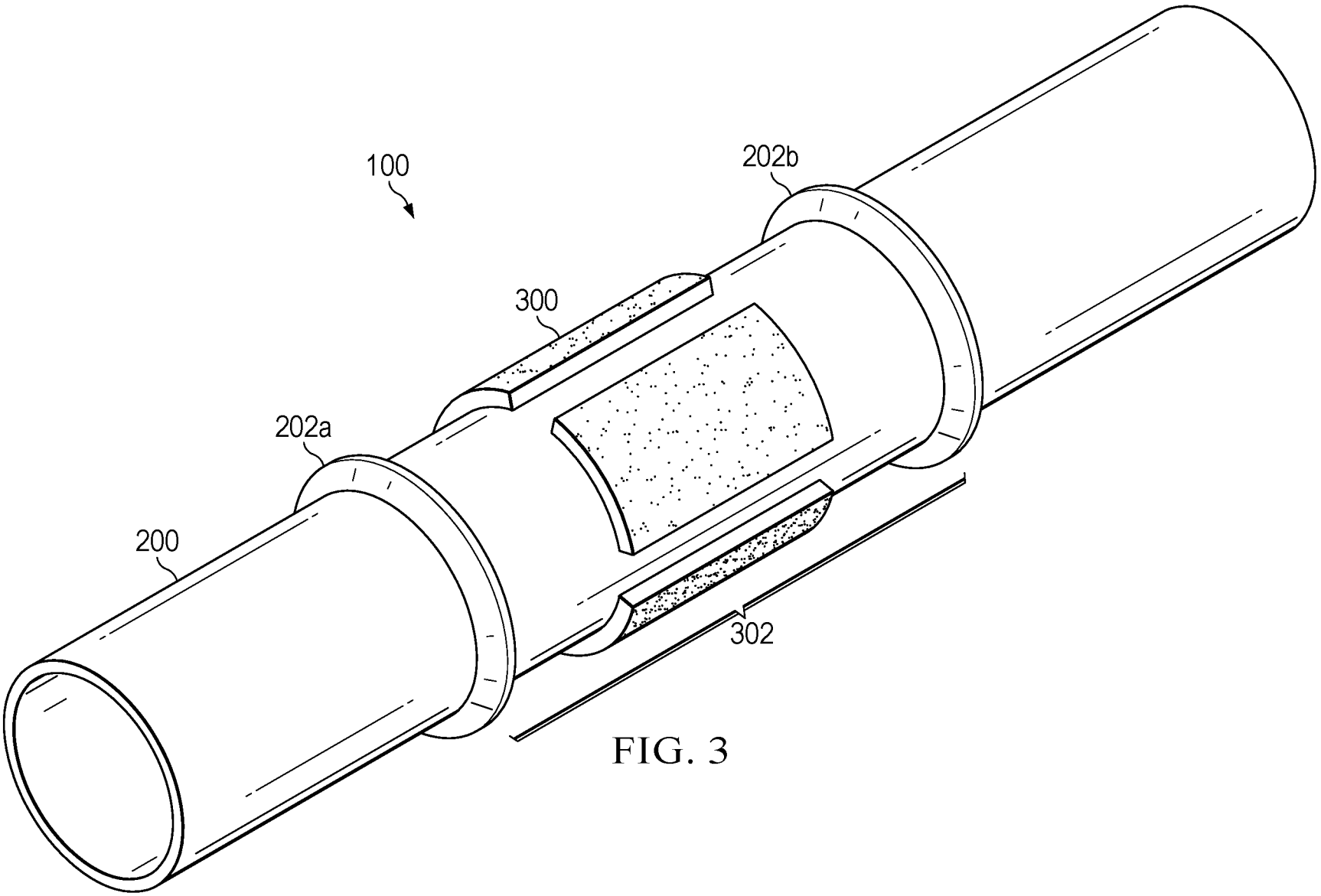
FIG. 3 illustrates a perspective view of the ELH including at least one foam member, in accordance with examples of the present disclosure.

FIG. 3 illustrates the tool 100 with at least one foam member 300, in accordance with examples of the present disclosure. The foam member 300 may include closed cells and is disposed on the body 200 of the tool 100 within the void 302 that is defined partially by the body 200, the rib 202*a*, and the rib 202*b* (i.e., the void 302 is also defined by casing that the ribs engage). The foam member 300 is at least partially solid. For example, the foam member 300 has a solid mass of known total volume including a percentage/portion that includes air pockets that are not in communication with the surrounding void 302. This closed cell structure has porosity but no permeability.

The foam member 300 may be manufactured from any number of materials for example, polymers such as polyurethane, elastomers, metals, ceramics, resins, and/or composites. The foam may fill the entire void 302 between the ribs 202*a* and 202*b* or at least a portion of the void 302. The foam may be shaped in any geometry within the spacing between the adjacent ribs and may include a single member or multiple members spaced around the body 200 (e.g., along circumference) of the tool 100 (e.g., ELH). The foam member 300 may be attached to the body 200 in a variety of ways including bonded directly, mechanically connected, a combination of both or other means.

The available fluid volume between the rib 202*a* and the rib 202*b* is the rib-to-rib volume less the volume of the closed cell foam member 300 in its run-in-hole (RIH) state. Thicknesses of the foam member and other dimensions such as length and width may vary depending on particular applications. In some non-limiting examples, a thickness may range from 0.1 inch to 6 inches; a length around a tubular body may vary depending on diameter of tubular body (e.g., 2-20 inches or more); and a width from rib to rib may vary (e.g., 1-20 inches or more).

Figure 4:
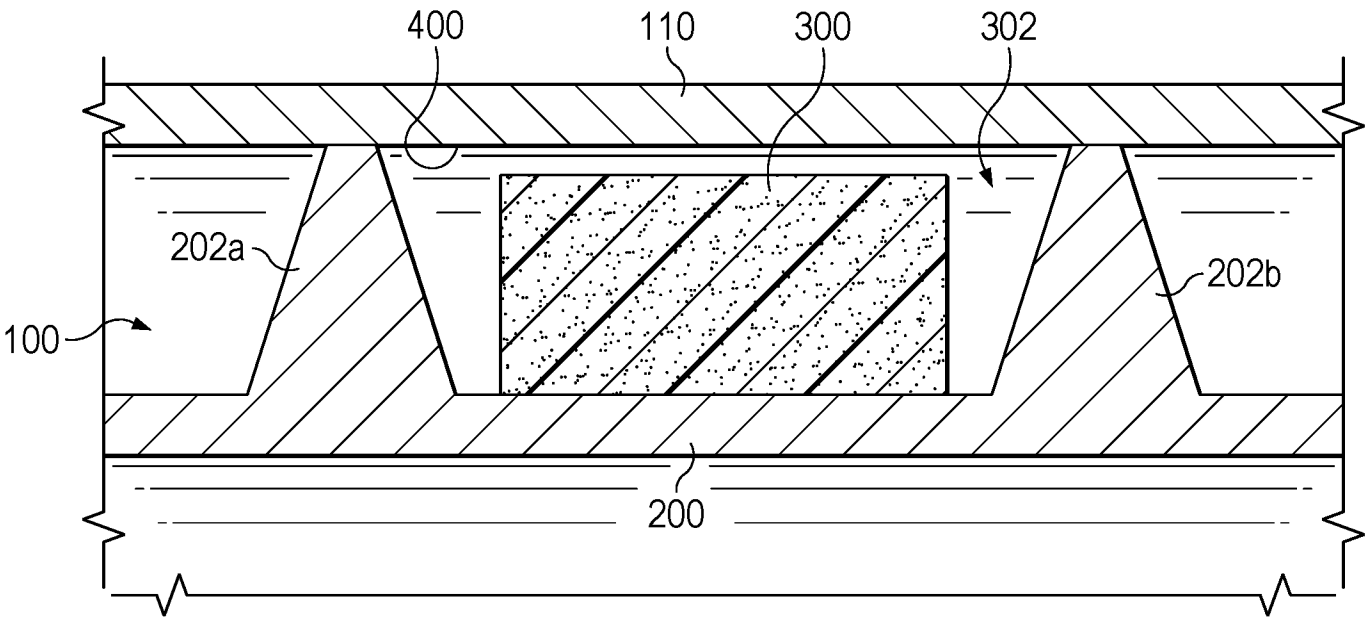
FIG. 4 illustrates a close-up view of the ELH contacting an inner surface of a conduit, in accordance with examples of the present disclosure.

FIG. 4 illustrates a cross-sectional view (e.g., side view) of the tool 100 engaged with casing 110, in accordance with examples of the present disclosure. The void 302 is defined by the body 200, the rib 202*a*, the rib 202*b*, and the casing 110 (e.g., casing ID/inner surface 400). The foam member 300 is disposed in the void 302 and is not compressed. As noted previously, the foam may be shaped in any geometry within the spacing between the adjacent ribs and may include a single member or multiple members spaced around the body 200 (e.g., along circumference) of the tool 100 (e.g., ELH). The foam member 300 may be attached to the body 200 in a variety of ways including bonded directly, mechanically connected, a combination of both or other means.

With the reduction of the total volume of the foam and inclusion of some of the foam air pocket volumes (shown on FIG. 5) to the available fluid volume, the available fluid volume between the rib 202*a* and the rib 202*b* increases upon failing of the foam. This increased fluid volume then allows for unrestricted rib expansion with non-compressible fluids or mitigates rib engagement reduction from compressible fluid expansion due to thermal cycles. The foam member 300 also provides a minimal increase in buoyancy, thereby reducing the effective weight of the tool 100 (e.g., ELH) which facilitates deployment in extended reach wells.

Figure 5:
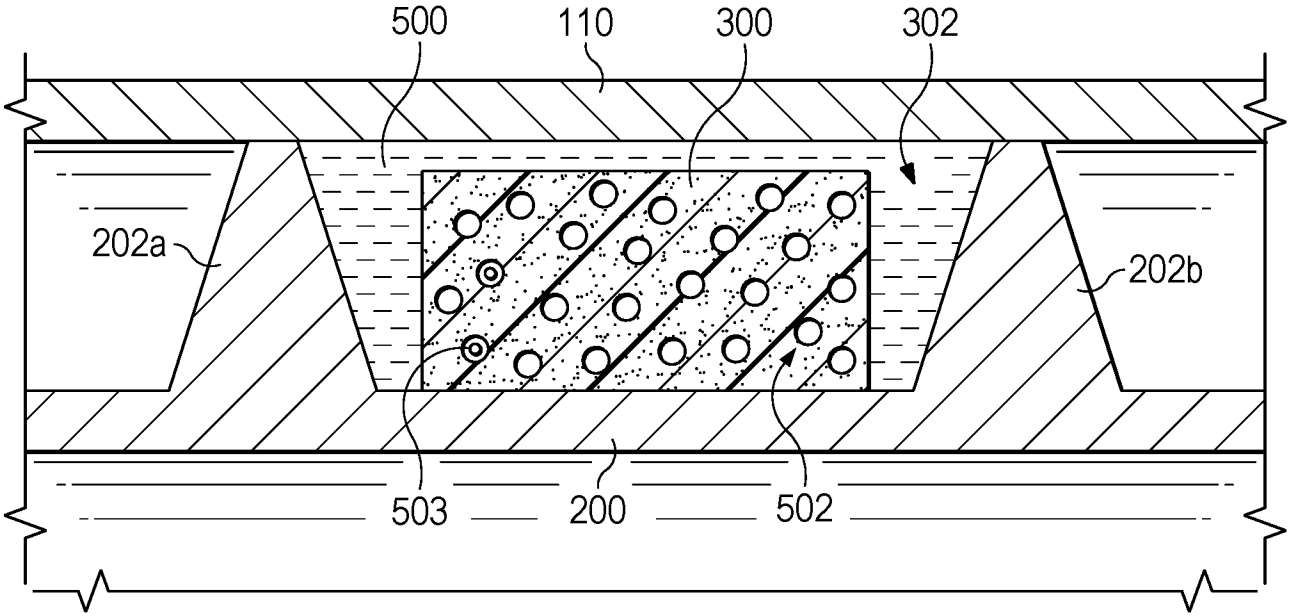
FIG. 5 illustrates the foam member including air pockets in a non-compressed state, in accordance with examples of the present disclosure.

FIG. 5 illustrates a cross-sectional view (e.g., side view) of the tool 100 including wellbore fluid 500 trapped in the void 302, in accordance with examples of the present disclosure. For example, the tool 100 may be run into a well that contains fluid (e.g., water). The void 302 is defined by the body 200, the rib 202*a*, the rib 202*b*, and the casing 110. The foam member 300 is disposed in the void 302, includes air pockets 502, and is not compressed. The percentage (e.g., 5%-80%) of the air pockets 502 may be modified to engineer the collapse pressure/load to the specific application.

The air pockets 502 (e.g., closed cells) may incorporate or be generated by hollow beads/spheres/particles 503 to further enhance collapse capacity. These spheres can be made from glass, composite, ceramic, polymer, metal and/or other materials. The foam member 300 when exposed to either increased pressure from adjacent wellbore fluid 500 or to mechanical load from the expansion/setting process, collapses, and crushes the air pockets 502 thereby reducing the volume of the foam member 300 in addition to connecting some or all of the air pockets to the outside the void 302.

Figure 6:
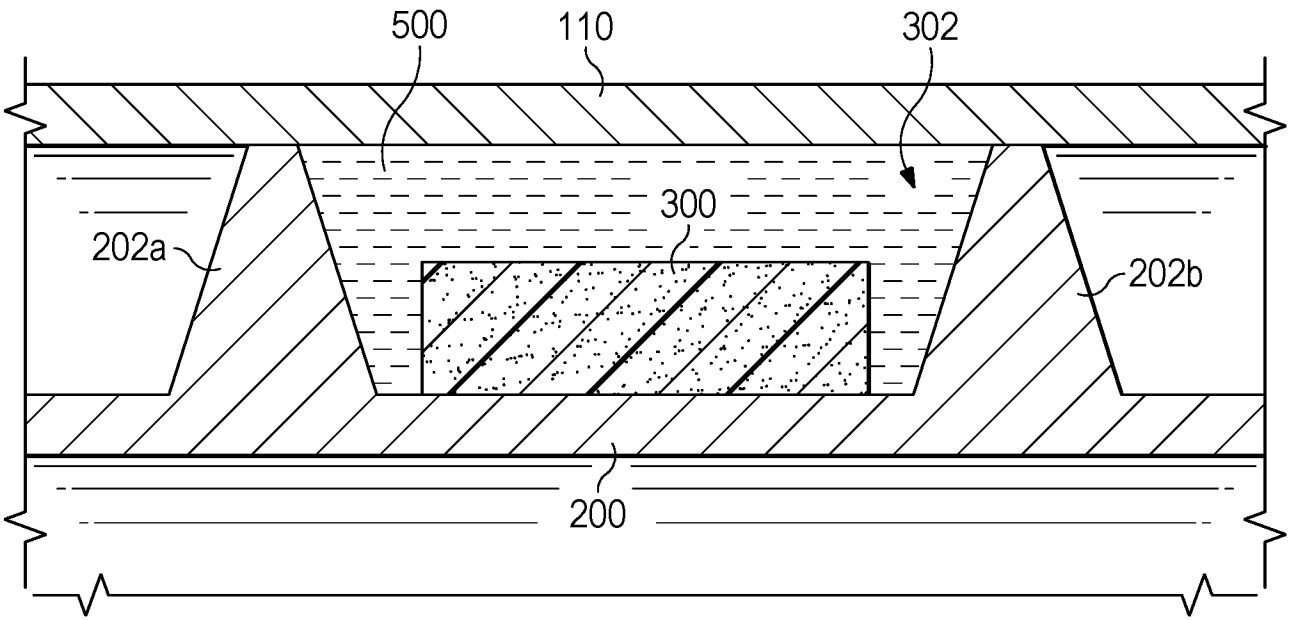
FIG. 6 illustrates the foam member in a compressed state, in accordance with examples of the present disclosure.

FIG. 6 illustrates a cross-sectional view (e.g., side view) of the tool 100 with the foam member 300 in a compressed state, in accordance with examples of the present disclosure. The void 302 is defined by the body 200, the rib 202*a*, the rib 202*b*, and the casing 110. The foam member 300 is compressed in the void 302 and the air pockets have collapsed. The wellbore fluid 500 is trapped in the void 302 and surrounds/contacts the foam member 300. The foam member 300 when exposed to either increased pressure from adjacent fluid or to mechanical load from the expansion process, collapses, and crushes the air pockets thereby reducing the volume of the foam member in addition to connecting some or all of the air pockets to the outside void.

With the reduction of the total volume of the foam and inclusion of some of the foam air pocket volumes to the available fluid volume, the available fluid volume between the ribs increases upon failing of the foam. This increased fluid volume then allows for unrestricted rib expansion with non-compressible fluids or mitigates rib engagement reduction from compressible fluid expansion due to thermal cycles. The mechanism also provides a minimal increase in buoyancy, thereby reducing the effective weight of the hanger which facilitates deployment in extended reach wells.

Figure 7:
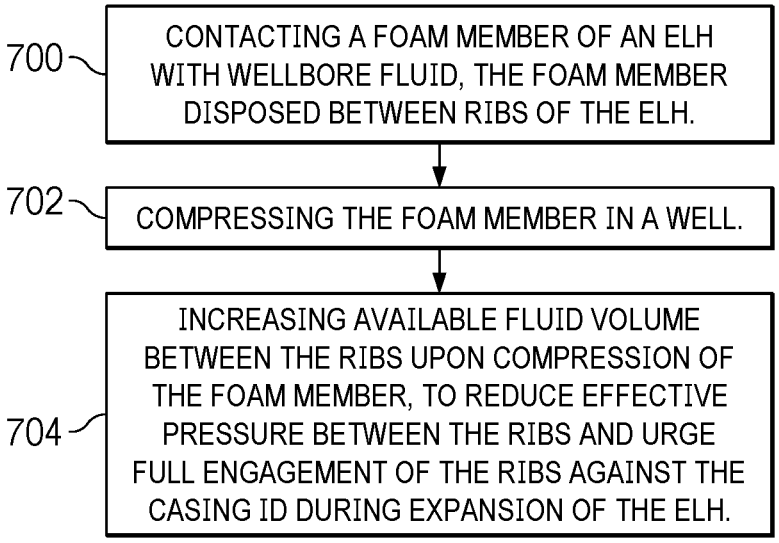
FIG. 7 illustrates an operative sequence for increasing available fluid volume in a void defined by the ELH and casing, in accordance with examples of the present disclosure.

FIG. 7 illustrates an operative sequence for increasing the effective volume in the void space once the ribs engage the casing/conduit ID allowing for full engagement of the ribs against the casing ID during expansion of the ELH, in accordance with examples of the present disclosure. At step 700, a foam member of an ELH is disposed in a well and contacts wellbore fluid (e.g., see FIGS. 1 and 5). The foam member may be manufactured from any number of materials for example, polymers such as polyurethane, elastomers, metals, ceramics, resins, and/or composites.

The foam may fill the entire void between the ribs or at least a portion of the void (see FIG. 4). The foam may be shaped in any geometry within the spacing between the adjacent ribs and may include a single member or multiple members spaced around the body of the hanger. The percentage/portion (e.g., 5%-80%) of air pockets may be modified to engineer the collapse pressure/load to the specific application (see FIG. 5).

The air pockets may incorporate or be generated by hollow beads/spheres to further enhance collapse capacity. These spheres can be made from glass, composite, ceramic, polymer, metal and/or other materials. Thicknesses of the foam member and other dimensions such as length and width may vary depending on particular applications. In some examples, a thickness may range from 0.1 inch to 6 inches. A length/distance around a tubular body may vary depending on diameter of tubular body (e.g., 2-20 inches or more). The width/distance from rib to rib may vary (e.g., 1-20 inches or more). The foam member may be attached to the ELH member in a variety of ways including direct bonding, mechanical connections, a combination of both or other means.

At step 702, the foam member is compressed (see FIG. 6). For example, the foam member is exposed to either increased pressure from adjacent fluid or to mechanical load from the expansion process (setting of ELH), collapses, and crushes the air pockets, thereby reducing the volume of the foam member in addition to connecting some or all of the air pockets to the outside void.

At step 704, the available fluid volume between the ribs increases due to compression of the foam member. This increase in fluid volume urges full engagement of the ribs against the casing ID upon expansion/setting of the ELH. This allows for a more secure hold/grip within the casing/conduit during mechanical loading (setting/expanding ribs) and pressure fluctuations due to temperature changes in the well. Increasing available fluid volume between the ribs upon compression of the foam member reduces effective pressure between the ribs and urges full engagement of the ribs against the casing ID during expansion of the ELH.

Accordingly, the systems and methods of the present disclosure increase fluid volume during mechanical loading and thermal cycling via a foam member disposed in a void defined by the ELH and casing engaged by the ELH. The systems and methods may include any of the various features disclosed herein, including one or more of the following statements.

Statement 1. A downhole tool comprising: a tubular body; ribs extending along a circumference of the tubular body; and at least one foam member disposed on the tubular body and between the ribs.

Statement 2. The downhole tool of the statement 1, wherein the at least one foam member includes closed cells.

Statement 3. The downhole tool of the statement 1 or the statement 2, wherein the at least one foam member includes air pockets.

Statement 4. The downhole tool of any one of the statements 1-3, wherein the at least one foam member includes hollow particles.

Statement 5. The downhole tool of any one of the statements 1-4, wherein the ribs are expandable.

Statement 6. The downhole tool of any one of the statements 1-5, wherein the at least one foam member is attached to the tubular body.

Statement 7. A system comprising: a downhole tool comprising: a tubular body; ribs extending along a circumference of the tubular body; and at least one foam member disposed on the tubular body and between the ribs; and a conduit, the downhole tool disposed in the conduit, wherein a void is defined by the tubular body, the ribs, and the conduit, wherein the at least one foam member is disposed in the void.

Statement 8. The system of the statements 7, wherein fluid is disposed in the void.

Statement 9. The system of any one of the statements 7-8, wherein the ribs are expandable.

Statement 10. The system of any one of the statements 7-9, wherein the at least one foam member includes air pockets.

Statement 11. The system of any one of the statements 7-10, wherein the at least one foam member includes hollow particles.

Statement 12. The system of the statement 11, wherein the at least one foam member is attached to the tubular body.

Statement 13. A method comprising: disposing a downhole tool in a conduit, the downhole tool comprising: a tubular body; ribs extending along a circumference of the tubular body; and at least one foam member disposed on the tubular body and between the ribs; and contacting an inner surface of the conduit with the ribs, wherein a void is defined by the tubular body, the ribs, and the conduit, wherein the at least one foam member is disposed in the void.

Statement 14. The method of the statement 13, further comprising compressing the at least one foam member to increase fluid volume within the void.

Statement 15. The method of any one of the statements 13-14, wherein contact between the ribs and the inner surface of the conduit occurs during expansion of the downhole tool.

Statement 16. The method of any one of the statements 13-15, wherein fluid is disposed in the void.

Statement 17. The method of any one of the statements 13-16, wherein the at least one foam member includes closed cells.

Statement 18. The method of any one of the statements 13-17, wherein the at least one foam member includes air pockets.

Statement 19. The method of any one of the statements 13-18, wherein the at least one foam member includes hollow particles.

Statement 20. The method of any one of the statements 13-19, wherein the conduit comprises casing.

Although the present disclosure and its advantages have been described in detail, it should be understood that various changes, substitutions, and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A downhole tool comprising:

a tubular body;

ribs extending along a circumference of the tubular body; and at least one polymeric closed-cell foam member disposed on the tubular body and between the ribs, wherein the at least one polymeric closed-cell foam member comprises between 5% and 80% air pockets in a non-compressed state, wherein the at least one polymeric closed-cell foam member is configured to collapse when fluidically exposed to either increased pressure or to mechanical load from expanding the tubular body to form a foam member in a compressed state, and wherein the collapsing of the at least one polymeric closed-cell foam member thereby reduces a volume of the at least one polymeric closed-cell foam member to urge full engagement of the ribs against a casing.

2. The downhole tool of claim 1, wherein the at least one polymeric closed-cell foam member comprises hollow particles.

3. The downhole tool of claim 1, wherein the ribs are expandable.

4. The downhole tool of claim 1, wherein the at least one polymeric closed-cell foam member is attached to the tubular body.

5. The downhole tool of claim 1, wherein the at least one polymeric closed-cell foam member comprises polymer and/or elastomer.

6. The downhole tool of claim 1, wherein the at least one polymeric closed-cell foam member comprises a composite.

7. The downhole tool of claim 1, wherein the at least one polymeric closed-cell foam member further comprises ceramic and/or resin.

8. A system comprising:

a downhole tool comprising:

a tubular body;

ribs extending along a circumference of the tubular body; and at least one polymeric closed-cell foam member disposed on the tubular body and between the ribs, wherein the at least one polymeric closed-cell foam member comprises between 5% and 80% air pockets in a non-compressed state, wherein the at least one polymeric closed-cell foam member is configured to collapse when fluidically exposed to either increased pressure or to mechanical load from expanding the tubular body to form a foam member in a compressed state, and wherein the collapsing of the at least one polymeric closed-cell foam member thereby reduces a volume of the at least one polymeric closed-cell foam member to urge full engagement of the ribs against a conduit; and the conduit, the downhole tool disposed in the conduit, wherein a void is defined by the tubular body, the ribs, and the conduit, wherein the at least one polymeric closed-cell foam member is disposed in the void.

9. The system of claim 8, wherein fluid is disposed in the void.

10. The system of claim 8, wherein the ribs are expandable.

11. The system of claim 8, wherein the at least one polymeric closed-cell foam member comprises hollow particles.

12. The system of claim 8, wherein the at least one polymeric closed-cell foam member is attached to the tubular body.

13. A method comprising:

disposing a downhole tool in a conduit, the downhole tool comprising:

a tubular body;

ribs extending along a circumference of the tubular body; and at least one polymeric closed-cell foam member disposed on the tubular body and between the ribs, wherein the at least one polymeric closed cell foam member comprises between 5% and 80% air pockets in a non-compressed state, wherein the at least one polymeric closed-cell foam member is configured to collapse when fluidically exposed to either increased pressure or to mechanical load from expanding the tubular body to form a foam member in a compressed state;

expanding the tubular boxy and contacting an inner surface of the conduit with the ribs, wherein a void is defined by the tubular body, the ribs, and the conduit, wherein the at least one polymeric closed-cell foam member is disposed in the void; and collapsing the at least one polymeric closed-cell foam member within the void to thereby reduce a volume of the at least one polymeric closed-cell foam member and urge full engagement of the ribs against the conduit.

14. The method of claim 13, further comprising compressing the at least one polymeric closed-cell foam member to increase fluid volume within the void.

15. The method of claim 13, wherein contact between the ribs and the inner surface of the conduit occurs during expansion of the downhole tool.

16. The method of claim 15, wherein fluid is disposed in the void.

17. The method of claim 13, wherein the at least one polymeric closed-cell foam member comprises hollow particles.

18. The method of claim 13, wherein the conduit comprises casing.

* * * * *